US007378060B2

(12) United States Patent
Sinha et al.

(10) Patent No.: US 7,378,060 B2
(45) Date of Patent: May 27, 2008

(54) SUPPORT SEAL FOR POSITIVE RETENTION OF CATALYTIC CONVERTER SUBSTRATE AND METHOD THEREFOR

(75) Inventors: Satyadeo Narain Sinha, Canton, MI (US); Charles Bryant Porter, Howell, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 471 days.

(21) Appl. No.: 10/906,149

(22) Filed: Feb. 4, 2005

(65) Prior Publication Data

US 2006/0177359 A1 Aug. 10, 2006

(51) Int. Cl.
*B01D 50/00* (2006.01)
*B01D 53/34* (2006.01)

(52) U.S. Cl. ..... 422/179; 422/180

(58) Field of Classification Search ..... 422/179–182
See application file for complete search history.

(56) References Cited

U.S. PATENT DOCUMENTS 4,142,864 A 3/1979 Rosynsky et al.
4,143,117 A 3/1979 Gaysert
4,328,187 A 5/1982 Musall et al.
4,335,077 A 6/1982 Santiago et al.
4,344,922 A 8/1982 Santiago et al.
4,353,872 A 10/1982 Midorikawa
4,362,700 A * 12/1982 Hayashi et al. ..... 422/179
4,444,721 A 4/1984 Ohkata
4,864,095 A 9/1989 Yamashita et al.
4,958,491 A 9/1990 Wirth et al.
5,449,500 A 9/1995 Zettel
5,656,245 A * 8/1997 Fujisawa et al. ..... 422/179
5,866,079 A 2/1999 Machida et al.
6,017,498 A 1/2000 Harding
6,286,840 B1 9/2001 Zettel

* cited by examiner

*Primary Examiner*—Walter D. Griffin
*Assistant Examiner*—Frank C Campanell
(74) *Attorney, Agent, or Firm*—Damian Porcari; Brooks Kushman P.C.

(57) ABSTRACT

A support seal for use with a catalytic converter having a housing, which includes an inlet end cone, an outlet end cone, and a shell forming an internal chamber, and catalytic substrate disposed within the internal chamber. The support seal has an "L" shaped cross-section including a radial portion and an axial portion, at least one portion for supporting and retaining the catalytic substrate within the internal chamber. The axial and radial portion of the "L" shaped seal can be preloaded to provide support to the substrate in the axial and radial directions.

19 Claims, 5 Drawing Sheets

SUPPORT SEAL FOR POSITIVE RETENTION OF CATALYTIC CONVERTER SUBSTRATE AND METHOD THEREFOR

BACKGROUND OF THE INVENTION

1. Field of the Invention

One aspect of the present invention generally relates to a catalytic converter, and more specifically, to a support seal for a catalytic converter.

2. Background Art

Catalytic converters are utilized in vehicles for reacting with hot vehicle exhaust gases and for purifying such gases. The catalytic converter typically includes a substrate, often times referred to as a brick. The substrate is often constructed of a ceramic material. The substrate may include channels or other fluid conduits, such as honeycombs, for the passage of the hot exhaust gases. A catalyst is added to the substrate for carrying out the catalytic function.

The catalytic converter also includes a housing having a chamber, an inlet for receiving gas, and an outlet for exhausting gas. In many applications, the brick is positioned within the chamber for performing the gas purifying function. A support member, for example, a mat or a wire mesh, is often wrapped around the substrate for supporting the brick with respect to the housing. As non-limiting examples, the mat can be made from intumescent or non-intumescent material. An example of an intumescent material is the INTERAM product, available from 3M of Minneapolis, Minn. The wire mesh can be made from stainless steel wire drawn from rod which is woven or knitted. The substrate support member which is placed between the substrate and the shell exerts pressure radially to hold the substrate in place. This pressure prevents the substrate from movement, thus preventing damage during service. The support member can also absorb shock caused when the vehicle is driven over uneven road surfaces, for example pot holes or dirt roads.

In certain circumstances, when a wire mesh type support member is used, the support member does not effectively limit the leakage of untreated gas through the catalytic converter chamber. As such, seals have been utilized to reduce the leak rates to tolerable levels. A seal is commonly fixed to the inlet and/outlet ends of the chamber and is disposed between the substrate and the chamber. In many applications, these seals can be particularly effective and economical for use with catalytic converters. The seal compensates for surface irregularities and/or voids on or between the substrate and/or chamber caused by the flexibility of the support member. The seal can be constructed of wire such that it can withstand relatively high temperatures typical of the catalytic converter environment. Knitted wire elements can be used as the seals. The seal sometimes can be covered with fiberglass fabric. Filler materials can also be added to reduce leakage rates.

One proposal provides a seal with a V-shaped configuration. The seal can be formed such that the apex of the V-shape is disposed on one side of the seal and the legs of the V-shape diverge from the apex to define interior and exterior surfaces of the seal. The legs of the seal can have an angle of divergence of about 60 degrees for substantially the entire length of the seal.

Current catalytic converters with or without seals are designed such that there is some space left on either side of the substrate along the length of the inside surface of the chamber. As such, the substrate is held in place by forces generated by the support member around the surface of the substrate in a radial direction only. As a result, the brick can experience movement in the axial direction when the radially restraining force level deteriorates over a period of time in use. This radial movement of the brick can be detrimental to the brick, and may eventually cause brick failure.

In light of the foregoing, what is needed is a support seal for providing support in the axial direction of a catalytic converter housing. What is also needed is a catalytic converter having a support seal with a mechanical design with relative high durability and/or robustness.

SUMMARY OF THE INVENTION

One aspect of the present invention is a support seal for providing support in the axial direction to a substrate of a catalytic converter. Another aspect of the present invention is a catalytic converter having a support seal with relative high durability and/or robustness. Another aspect of the present invention is a support seal which is relatively simple to assemble for use with a catalytic converter. Yet another aspect of the present invention is a support seal which can serve as a catalytic substrate edge chip protector during the assembly, i.e. the canning process. One aspect of the present invention is a support seal which provides vibration dampening in the radial and axial directions of a catalytic substrate. Yet another aspect of the present invention is a support seal made of a material having a higher thermal coefficient of expansion than that of the shell of the catalytic converter housing so as to provide contact pressure with the substrate in the axial direction at relatively elevated temperatures.

According to another aspect of the present invention, a support structure including a support seal is particularly useful for diesel applications and other applications with relatively large bricks since the support seal can represent a cost savings relative to conventional support structures due to material savings.

Yet another aspect of the present invention is a support structure including a support seal for use with high or low temperature applications requiring expensive materials having the proper resistance to degradation. Since less material is used relative to conventional support structures, a material cost savings can be realized.

According to a first embodiment of the present invention, a support seal for use with a catalytic converter is disclosed. The catalytic converter has a housing, which includes an inlet end cone, an outlet end cone, and a shell forming an internal chamber, and catalytic substrate disposed within the internal chamber. The support seal has an "L" shaped cross-section including a radial portion and an axial portion both for supporting and retaining the catalytic substrate within the internal chamber.

In certain embodiments, the radial portion provides support and retention of the catalytic substrate in a radial direction and the axial portion provides support and retention of the catalytic substrate in an axial direction. Moreover, the radial portion can provide support and retention of the catalytic substrate primarily in a radial direction and the axial portion can provide support and retention of the catalytic substrate primarily in an axial direction. The radial portion can include a radial engagement surface for engaging a portion of the radial surface of the catalytic substrate. The axial portion can include an axial engagement surface for engaging a portion of an axial surface of the catalytic substrate. The width of the axial engagement portion can be at least about 0.10 inches. In certain embodiments, the support seal exhibits minimal hysterisis after multiple compression and relaxation duty cycles.

According to another embodiment of the present invention, a catalytic converter assembly is disclosed. The assembly includes a housing including an inlet end cone, an outlet end cone, and a shell defining an internal chamber; a catalytic substrate disposed within the internal chamber; a support member disposed between the shell and the catalytic substrate within the internal chamber; and first and second support seals each having an "L" shaped cross-section comprising a radial portion and an axial portion both for supporting and retaining the catalytic substrate within the internal chamber.

In certain embodiments, the inlet and outlet end cones each have a flange portion for contacting the axial portion of the first and second support seals, respectively. Each flange portion can be a circular flange portion. Each circular flange portion can have an outer diameter which is substantially equal to the inner diameter of the shell.

In certain embodiments, the catalytic substrate includes a thick skin for protecting the catalytic substrate. The catalytic substrate can also include an elongate catalytic brick and one or more rows of plugged cells disposed on each axial side of the elongate catalytic brick. The first and second support seals can be formed of knitted wire mesh. In certain embodiments, the first and second support seals each have a thermal coefficient of expansion higher than that of the shell of the catalytic converter housing. The support seal can be preloaded in the axial and radial directions of the support seal.

According to yet another embodiment of the present invention, a method of forming a catalytic converter is disclosed. The method can be referred to as an assembly or canning method. The method includes disposing a first support seal having an axial portion and a radial portion on the first end of a catalytic substrate; disposing a second support seal having an axial portion and a radial portion on the second end of the catalytic substrate; disposing the catalytic substrate and the first and second support seals within a catalytic converter shell; aligning an inlet end cone with the second support seal such that a portion of the inlet end cone contacts the second support seal and the housing; aligning an outlet end cone with the first support seal such that a portion of the outlet end cone contacts the first support seal and the housing; and attaching the inlet end cone and outlet end cone to the housing.

In certain embodiments, the portion of each end cone contacting each respective support seal and the housing is a flange portion. Each aligning step can include applying pressure in the axial direction towards the center of the housing such that each respective support seal is compressed in an axial direction during the attaching step. The two aligning steps can be carried out simultaneously.

The above and other aspects and features of embodiments of the present invention are readily apparent from the following detailed description of the best mode for carrying out the invention when taken in connection with the accompanying drawings.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompany drawings which:

DETAILED DESCRIPTION OF EMBODIMENTS OF THE PRESENT INVENTION

As required, detailed embodiments of the present invention are disclosed herein. However, it is to be understood that the disclosed embodiments are merely exemplary of the invention that may be embodied in various and alternative forms. Therefore, specific functional details described herein are not to be interpreted as limiting, but merely as a representative basis for the claims and/or as a representative basis for teaching one of ordinary skill in the art to variously employ the present invention.

Figure 1:
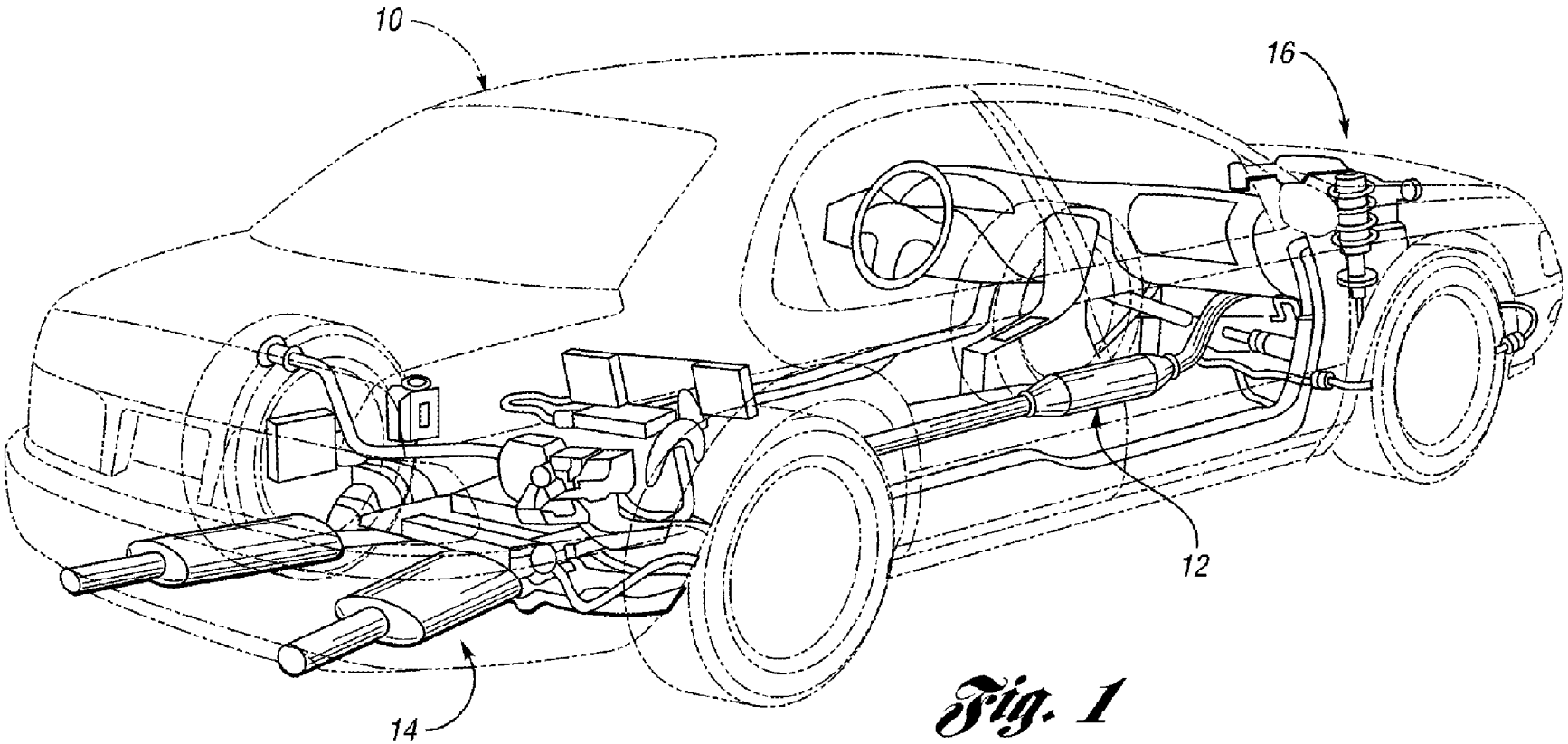
FIG. 1 is a perspective view of an automotive vehicle having a catalytic converter in accordance with certain embodiments of the present invention.

Referring to the drawings, FIG. 1 depicts automotive vehicle 10 having catalytic converter 12 for exhaust system, generally shown by arrow 14. Catalytic converter 12 purifies hot exhaust gases generated by engine 16 via a catalytic conversion process. The purified gases are exhausted through exhaust system 14.

Figure 2A:
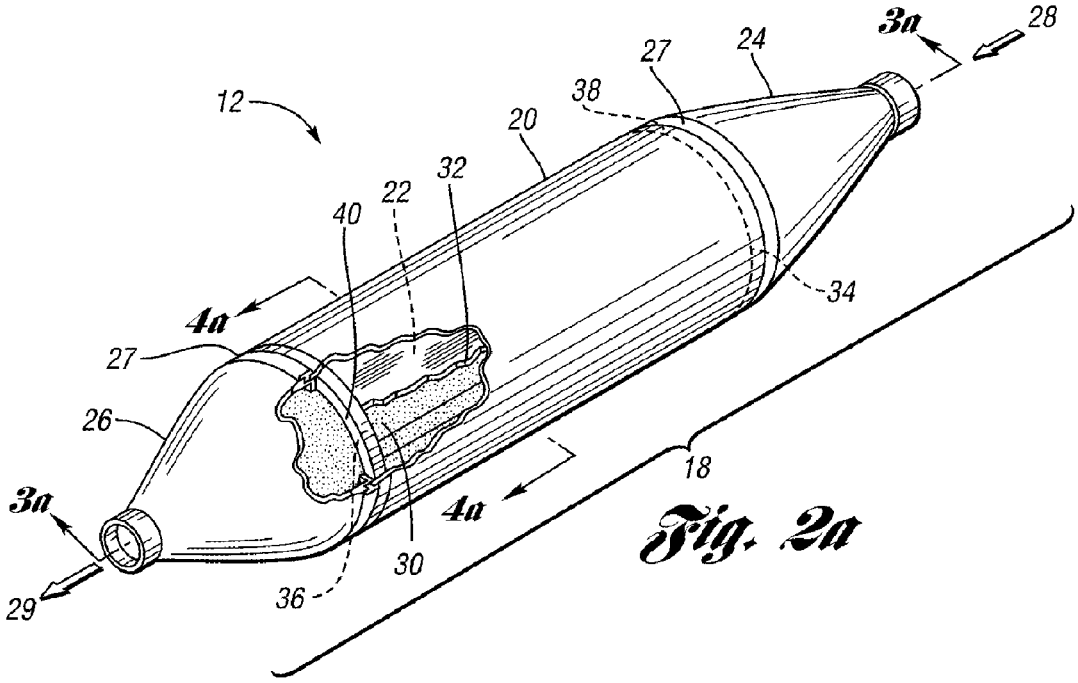
FIG. 2*a* is a perspective view of a catalytic converter with portions removed to reveal a support seal for supporting and retaining a brick in accordance with a first embodiment of the present invention.

According to FIG. 2*a*, catalytic converter 12 is shown in greater detail. Catalytic converter 12 includes elongate housing 18. Elongate housing 18 may be fabricated from a sheet metal material, for example stainless steel, 409 or 18CrCb or other metal material suitable for use with hot exhaust gases. It should be understood that elongate housing 18 can include multiple sections which may be welded or riveted together at their respective seams.

Elongate housing 18 includes shell 20, which is generally cylindrical in shape and has a generally circular cross-section. It should be understood that the shell may have other cross sectional shapes, such as generally rectangular, as depicted in FIG. 3*b*, or generally square, or other suitable cross-sections for use in the catalytic function. Shell 20 encloses internal chamber 22. Elongate housing 18 also includes inlet end cone 24 and outlet end cone 26, which are generally conical in shape and have a generally circular cross-section of varying diameter. It should be understood that the cones and may have other cross sectional shapes, for example, generally rectangular with varying side lengths, as depicted in FIG. 3*b*, or generally square, or other suitable cross-sections for use in the catalytic function. Each end cone 24 and 26 tapers from a first edge perimeter to a shorter second edge perimeter. A portion of each end cone adjacent to the first edge perimeter is attached to an edge of elongate housing in a suitable manner, for example welding. In FIG. 2*a*, welding material 27 has been applied to end cones 24 and 26 and shell 20 for welding the end cones to the shell to form elongate housing 18. Although not shown, inlet and outlet pipes are connected to the second edge perimeters of inlet and outlet end cones 24 and 26, respectively, to form a portion of the automotive exhaust system. Hot exhaust gases may be supplied to inlet end cone 24 in the direction represented by arrow 28, and enter internal chamber 22. Outlet end cone 26 exhausts hot gases from internal chamber 22 in the direction represented by arrow 29.

Catalytic substrate 30 is located within internal chamber 22 of elongate housing 18. It should be understood that one or more bricks can be disposed within elongate housing 18 side-by-side, i.e. in an axial orientation, can be used as catalytic substrate 30. Substrate 30 may include a thick skin or two or more rows of plugged cells. The cells may be linear or honeycomb for passing hot exhaust gases from inlet end cone 24 to outlet end cone 26. Substrate 30 can be formed from a ceramic material impregnated with a catalytic material for performing the catalytic function in any suitable known manner.

Catalytic substrate 30 is positioned and secured within internal chamber 22 by support mat 32 which is disposed within internal chamber 22 between shell 20 and the outer surface of catalytic substrate 30. Support mat 32 prevents movement and provides support to substrate 30 within internal chamber 22, most notably in the radial direction. Support mat 32 can be formed from an intumescent material, for example INTERAM 100 or 1100HT, available from 3M Company of St. Paul, Minn. Intumescent materials typically swell when exposed to hot gas so that the space between substrate 30 and shell 20 is occupied during utilization of catalytic converter 12. Support mat 32 can also be formed from a non-intumescent material. It should be understood that support mat 32 can also be formed of wire mesh. In other embodiments, support mat 32 can be omitted so that an air gap is formed between the surface of substrate 30 and the inner surface of shell 20. Beneficially, this configuration can represent a cost savings since less material is used. Moreover, the air gap acts as an insulator to distribute the heat generated by the hot vehicle exhaust gases. As such, the air gap configuration is useful in both high and low temperature applications.

Support mat 32 includes leading edge 34 adjacent to inlet end cone 24 and trailing edge 36 adjacent to outlet end cone 26. Support seals 38 and 40 can be fabricated from knitted metal wire. The embodiment shown in FIGS. 2*a* and 2*b* includes two support seals, although, it should be appreciated that other embodiments may include the use of a different amount of support seals, for example one support seal located adjacent to either edge of the substrate.

Under certain conditions, the radial support offered by support mat 32 can deteriorate over a period of time, which can cause movement of catalytic substrate 30, and eventual failure of the brick. As described in detail below, the use of support seals 38 and 40 can enhance brick support and restriction of movement in the radial direction, and provide support and restriction of movement in the axial direction. For example, shell 20 can expand in a radial direction during use, therefore imparting radial force upon support seals 38 and 40. Since the seals can be constructed of a compressible material, the seals allow the expansion to take place while supporting and retaining substrate 30. When shell 20 contracts after use, the seals can relax or expand to fill the gap created. The support seals may act as a damper, thus absorbing force and vibration created by the vehicle during driving. This configuration can enhance the longevity of catalytic substrate 30.

Figure 2B:
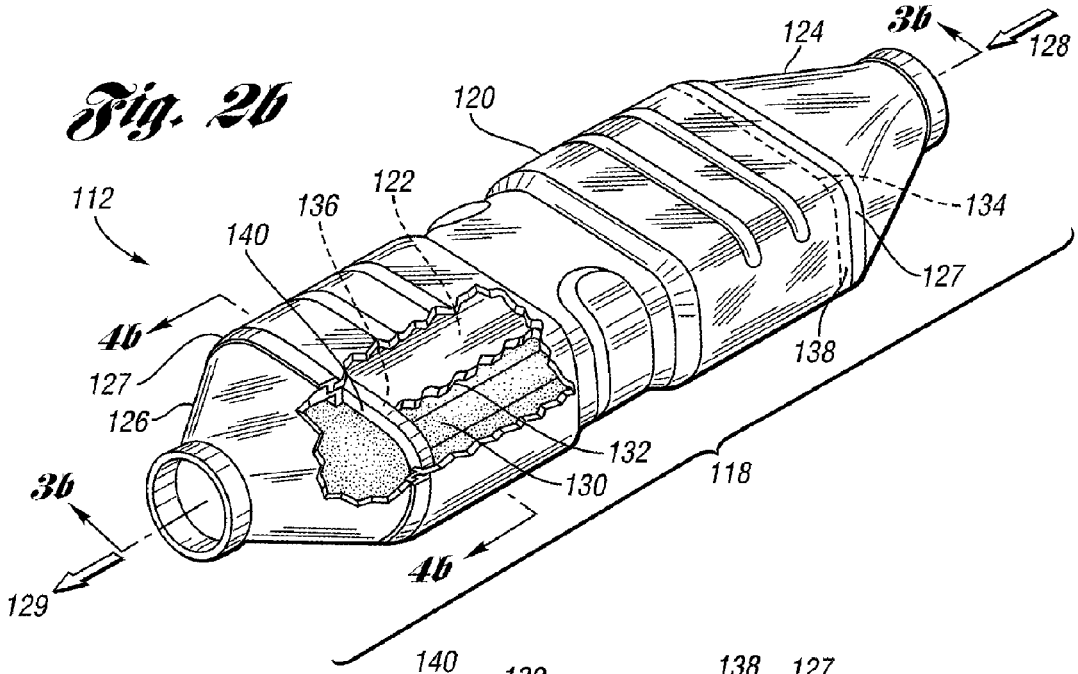
FIG. 2*b* is a perspective view of a catalytic converter with portions removed to reveal a support seal for supporting and retaining a brick in accordance with a second embodiment of the present invention.

With respect to FIG. 2*b*, catalytic converter 112 according to another embodiment of the present invention is shown in detail. Catalytic converter 112 includes elongate housing 118, which includes shell 120 having a generally rectangular cross-section and defining internal chamber 122, inlet end cone 124 and outlet end cone 126. It should be understood that elongate housing 118 can include multiple sections which may be welded or riveted together at their respective seams. Each end cone tapers from a first generally rectangular edge perimeter to a shorter second generally circular edge perimeter. A portion of each end cone adjacent the first edge perimeter is attached to an edge of elongate housing in a suitable manner, for example welding. Welding material 127 can be applied to end cones 124 and 126 and shell 120 for welding the end cones to the shell to form elongate housing 118. Hot exhaust gases may be supplied to inlet end cone 124 in the direction represented by arrow 128, and enter internal chamber 22. Outlet end cone 26 exhausts hot gases from internal chamber 22, in the direction represented by arrow 129.

Catalytic substrate 130 is located within internal chamber 122 of elongate housing 118. It should be understood that one or more bricks can be disposed within elongate housing 118 side-by-side, i.e. in an axial orientation, can be used as catalytic substrate 120. Substrate 130 may include a thick skin or two or more rows of plugged cells. The cells may be linear or honeycomb for passing hot exhaust gases from inlet end cone 124 to outlet end cone 126.

Catalytic substrate 130 is positioned and secured within internal chamber 122 by support mat 132 which is disposed within internal chamber 122 between shell 120 and the outer surface of catalytic substrate 130. Support mat 132 prevents movement and provides support to substrate 130 within internal chamber 122, most notably in the radial direction. Support mat 132 can be formed from an intumescent material, a non-intumescent material, wire mesh or other suitable material.

Support mat 132 includes leading edge 134 adjacent to inlet end cone 124 and trailing edge 136 adjacent to outlet end cone 126. Support seals 138 and 140 can be fabricated from knitted metal wire, and generally rectangular in shape.

Figure 3A:
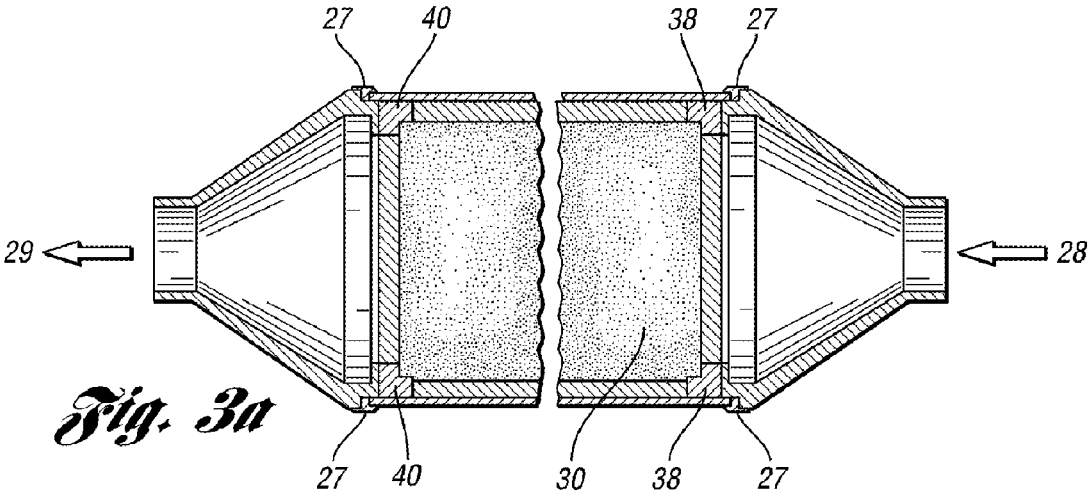
FIG. 3*a* is a cross-sectional view of the catalytic converter of FIG. 2*a* taken along line 3*a*-3*a;*
Figure 4A:
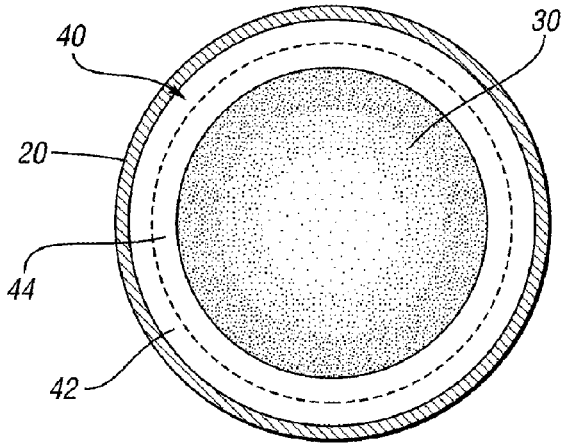
FIG. 4*a* is a cross-sectional view of the catalytic converter of FIG. 2*a* taken along line 4*a*-4*a;*
Figure 3B:
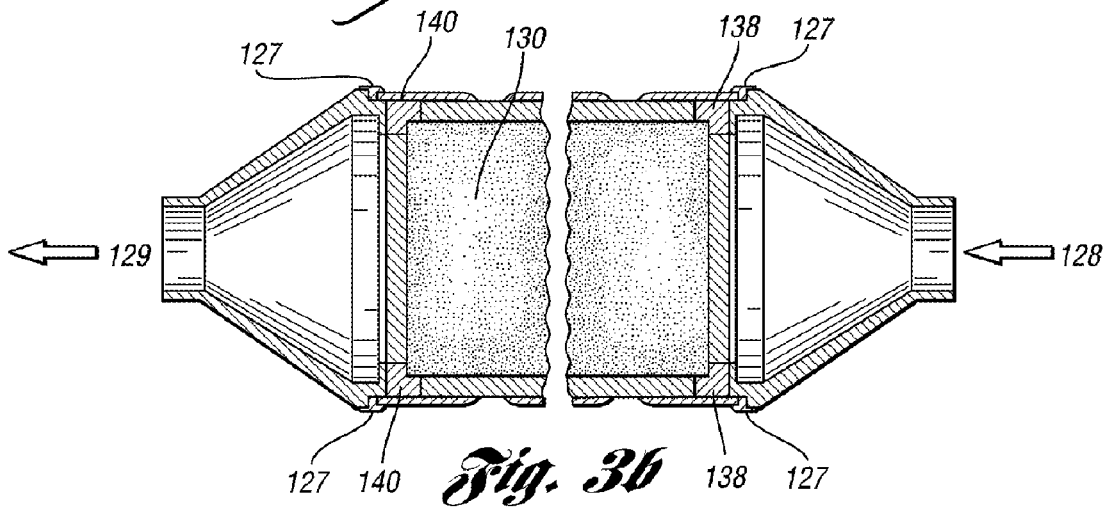
FIG. 3*b* is a cross-sectional view of the catalytic converter of FIG. 2*b* taken along line 3*b*-3*b;*
Figure 4B:
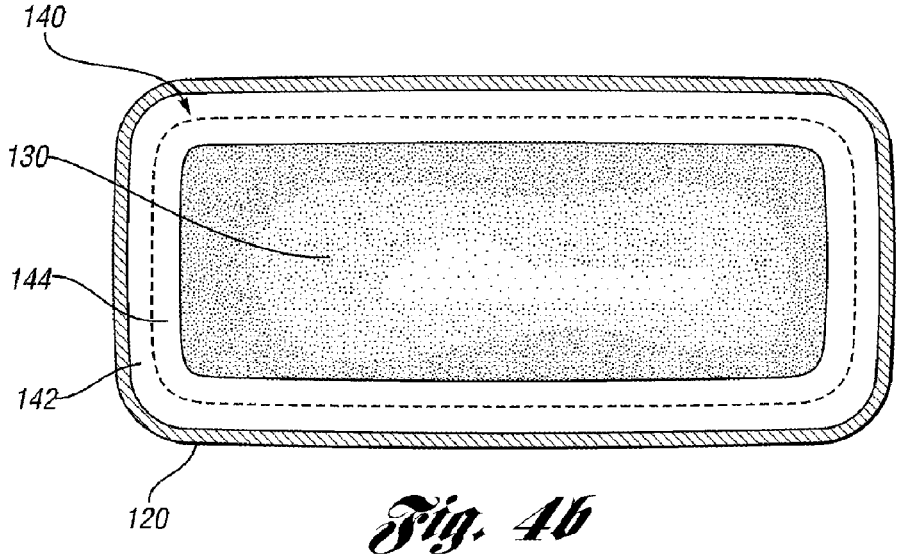
FIG. 4*b* is a cross-sectional view of the catalytic converter of FIG. 2*b* taken along line 4*b*-4*b;*
Figure 5A:
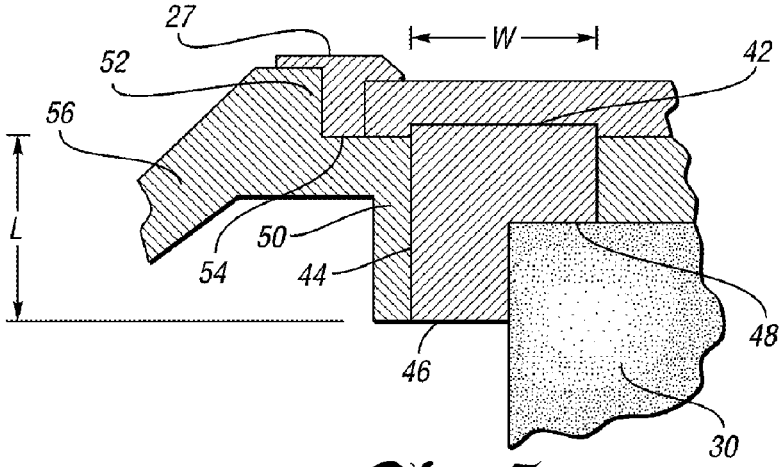
FIG. 5*a* is a fragmented, cross-sectional view of a portion of the catalytic converter shown in FIG. 2*a;*

Referring now to FIG. 3*a*, support seals 38 and 40 are shown with an "L" shaped cross section. FIG. 5*a* is a fragmented, cross-sectional view of a portion of the catalytic converter shown in FIG. 3*a*. FIG. 4*a* depicts support seal 40 taken along line 4*a*-4*a* of FIG. 2*a*. Alternatively, FIG. 3*b* depicts a cross-section of the substantially rectangular catalytic converter 112 taken along line 3*b*-3*b* of FIG. 2*b*. FIG.

4*b* depicts the substantially rectangular support seal 140 taken along line 4*b*-4*b* of FIG. 2*b*.

As shown in FIGS. 4*a* and 5*a*, the "L" shaped cross-section of the support seal includes axial portion 42 oriented in a substantially axial direction and radial portion 44 oriented in a substantially radial direction. It should be understood that the widths of axial and radial portions 42 and 44 can be substantially equal according to certain embodiments of the present invention. The axial and radial orientations thus described are relative catalytic converter 12. In certain embodiments, the width of axial (A) portion 42 is in range of about 0.25 inches to about 1.00 inches. In certain embodiments, the width of radial (R) portion 44 is in the range of about 0.25 inches to about 1.00 inches. In certain embodiments, the ratio of widths of axial portion 42 and radial portion 44 (A/R) is in the range of about 0.25 to about 4.00.

The support seal also includes axial engagement surface 46 for providing axial support to the brick and radial engagement surface 48 for providing radial support to the brick. In certain embodiments, the width of axial engagement surface 46 is in the range of about 0.06 inches to about 0.50 inches, and in other embodiments 0.125 inches. In certain embodiments, the width of radial engagement surface 48 is in the range of about 0.125 inches to about 1.00 inches.

At least a portion of axial portion 42 is in contact with circular flange portion 50 of the end cone. As depicted in FIG. 5*a*, the end cone is fabricated using a casting process. In certain embodiments, circular flange portion 50 has a length that is substantially equal to that of the width of axial portion 42. One end of circular flange portion 50 extends and connects to annular portion 52 so as to form seam 54 for receiving welding material 27. Annular portion 52 extends and connects to tapered portion 56, which extends towards the narrow end of the end cone. During assembly, welding material 27 is inserted in and around seam 54, and is welded to form a connection between shell 20 and end cones 24 and 26. A portion of each end cap slides under shell 20 to squeeze each support seal in an axial direction. In such embodiments, the outer diameter of a portion of circular flange 50 of the end cap is slightly less or equal to the inner diameter of shell 20.

Figure 6A:
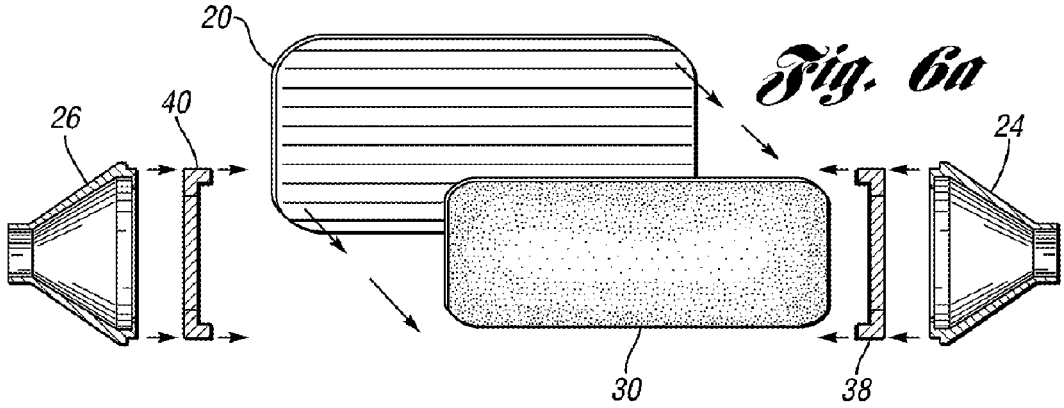
FIG. 6*a* is an exploded cross-sectional view of the catalytic converter shown in FIG. 2*a* in an unassembled state.

FIG. 3*a* depicts a cross-sectional view of assembled catalytic converter 12 according to one embodiment of the present invention, whereas FIG. 6*a* depicts an exploded cross-sectional view of catalytic converter 12 in an unassembled (ready for canning) state. In FIG. 6*a*, support mat 32 has been omitted to show that in certain embodiments an air gap can be created by using the disclosed support seals. According to one method embodiment of the present invention, support seals 38 and 40 are then positioned to mate with opposing ends of substrate 30. As the next step, an unassembled shell is slid over the support seal and substrate combination. The unassembled shell has a slightly greater inner diameter than that of the outer diameter of the support seals, allowing the shell to freely slide over the support seals. Once in place, a clamp or other suitable device is used to reduce the diameter of the shell, squeezing the radial portion of the seal to provide sufficient holding pressure in the radial direction, and bringing the support seals into supporting and retaining contact with the inner surface of the shell. For a cylindrical housing, this radial preload can be increased further by performing a swaging operation on the outer shell of the converter, thus reducing the outer shell diameter.

Next, inlet and outlet end cones 24 and 26 are positioned such that circular flange portion 50 of each end cone mate with at least a portion of the axial portion of each support seal. According to certain embodiments of the present invention, axial pressure is simultaneously applied to end cones 24 and 26 during assembly and welding of catalytic converter 12. The pressure can be provided by any suitable means, for example hydraulics or electromechanical means. As can be seen from FIG. 5*a*, a portion of each end cap slides within internal chamber 22 and contacts the inner surface of shell 20, and presses up against support seals 38 and 40 to apply axial pressure to the support seals. Once the end cones are positioned and pressurized, welding material 27 can be placed in and around seam 54. While under pressure, welding material 27 is welded to shell 20 and end cones 24 and 26 to form a mechanical connection between these elements. A broad range of welding materials can be utilized based on their compatibility with the materials used for the end cones and shell.

Advantageously, the assembled converter 12 provides end cones 24 and 26 which provide axial contact pressure to support seals 38 and 40 against substrate 30, while maintaining radial contact pressure between substrate 30 and the outer shell 20.

Figure 5B:
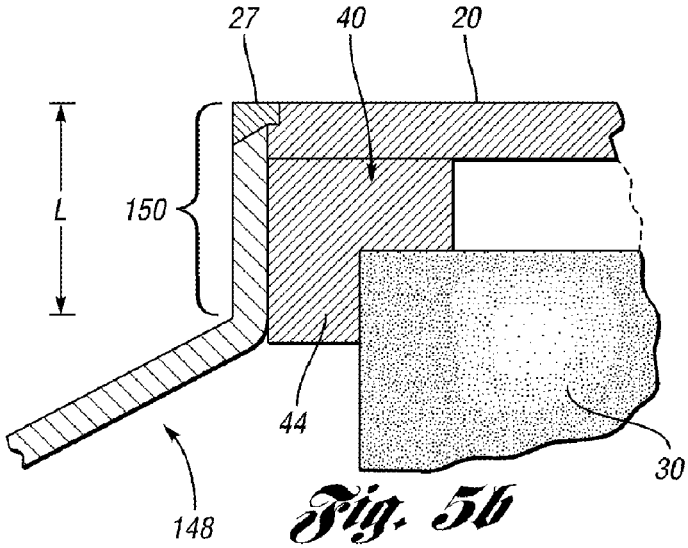
FIG. 5*b* is a fragmented, cross-sectional view of an alternative end cone according to an embodiment of the present invention.
Figure 6B:
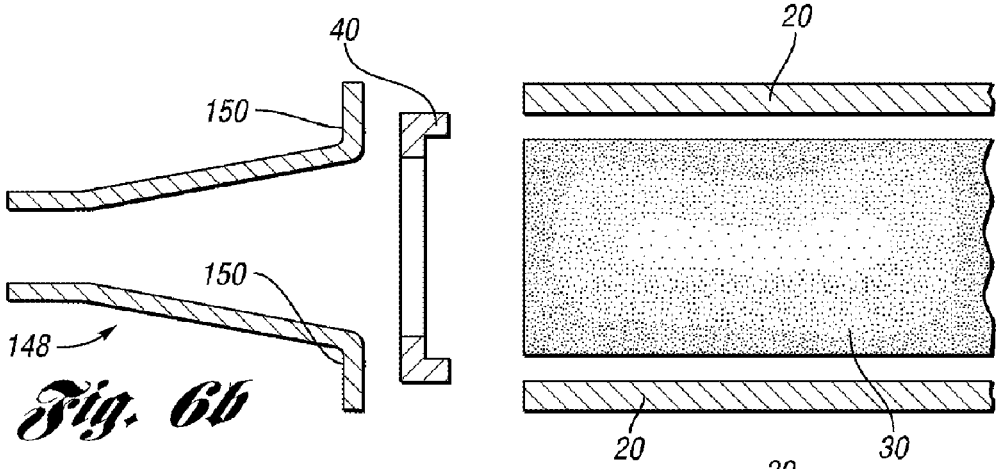
FIG. 6*b* is a fragmented, exploded cross-sectional view of the shell and brick assembly of FIG. 2*a* with the alternative end cone as shown in FIG. 5*b;*

According to another embodiment of the present invention, end cone 148 can be fabricated with outwardly flared portion 150, as depicted in FIGS. 5*b* and 6*b*. In such an embodiment, outwardly flared portion 150 can be constructed to have a length suitable to contact the width of shell 20 and the width of axial portion 44. Welding material 27 can be applied as shown to attach end cone 148 to shell 20. Although end cone 148 is shown in accordance with the substantially cylindrical shell 20, end cone 148 can be modified to be used with shells having rectangular or other shapes.

Figure 5C:
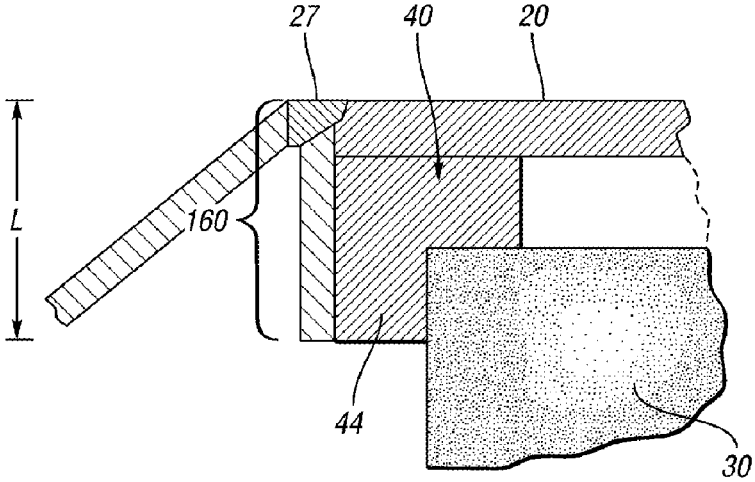
FIG. 5*c* is a fragmented, cross-sectional view of an alternative end cone according to an embodiment of the present invention.
Figure 6C:
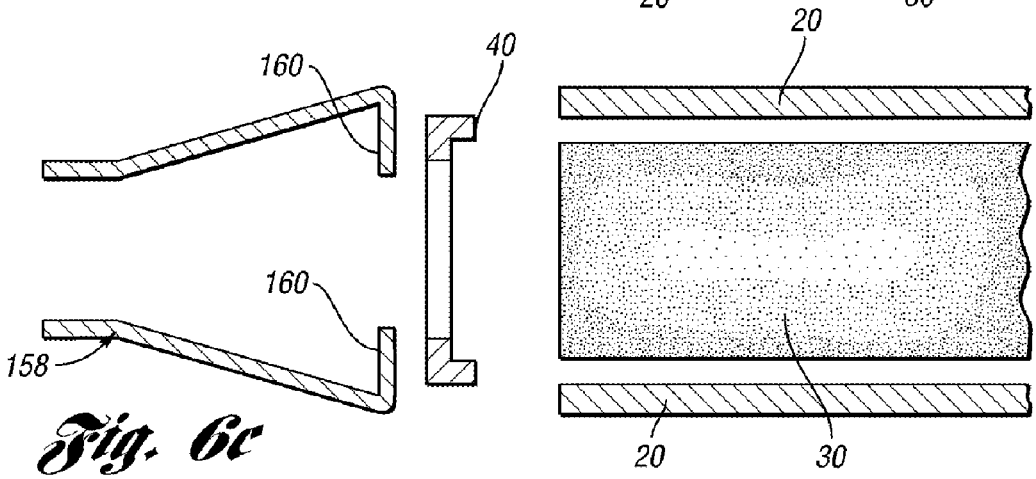
FIG. 6*c* is a fragmented exploded cross-sectional view of the shell and brick assembly of FIG. 2*a* with the alternative end cone as shown in FIG. 5*c;*

According to yet another embodiment of the present invention, end cone 158 can be fabricated with inwardly flared portion 160, as depicted in FIGS. 5*c* and 6*c*. In such an embodiment, inwardly flared portion 160 can be constructed to have a length suitable to contact the width of shell 20 and the width of axial portion 44. Welding material 27 can be applied as shown to attach end cone 158 to shell 20. Although end cone 158 is shown in accordance with the substantially cylindrical shell 20, end cone 158 can be modified to be used with shells having rectangular or other shapes.

Figure 7A:
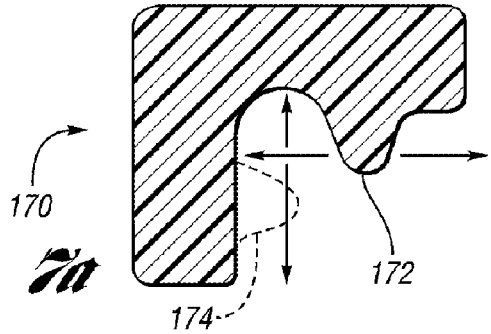
FIG. 7*a* is a cross-sectional side view of a support seal according to an embodiment of the present invention.
Figure 7B:
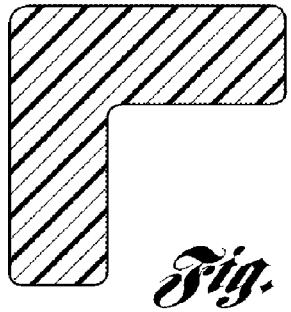
FIG. 7*b* is a cross-sectional side view of a support seal according to another embodiment of the present invention.

In certain embodiments of the present invention, a support seal 170 can be fabricated with collapsible lips, as depicted by a cross-sectional view of support seal 170 in FIG. 7*a*. Although collapsible lip 172 is shown on the radial portion of seal 170, another collapsible lip 174 can be included as part of the axial portion. The collapsible lip collapses during canning process, to provide an increased surface area, thereby providing increased engagement pressure. This pressure can provide beneficial support and retention qualities to support seal 170. Alternatively, FIG. 7*b* depicts a support seal without a collapsible lip.

The support engagement area on the substrate can be fabricated of various materials. For example, a relatively thick skin can be applied to the substrate prior to assembly. In certain embodiments, the thickness of the relatively thick skin can be in the range of about 0.03125 (1/32) inches to about 0.25 (1/4) inches. In certain embodiments, the thickness can track the width of axial engagement surface 46. Alternatively, the substrate can include a number of bricks aligned in an axial direction. The bricks located adjacent to the leading and trailing edges of the catalytic substrate can be one or more rows of plugged cells. The one or more rows of plugged cells sandwich an elongated catalytic brick which performs the catalytic function. In certain embodiments, the cells can be plugged to a depth of about one inch or more to provide rigidity and/or savings since the precious metal coating does not have to be applied to the plugged cells. In certain embodiments, the axial length of the elongated brick can be varied to compensate for loss of catalytic volume due to the plugged cell arrangement. The axial length can vary depending on the tail pipe emission requirements. According to certain embodiments, as part of the final catalytic converter assembly, and after building the middle elongate brick section of the converter, the end cones can be brought in on both sides of the middle section, aligned and pressed from both ends against the seals and then welded.

The "L" cross-section support seal design according to certain embodiments of the present invention can provide an amount of compression on the support seal in the axial direction of the substrate for axial support and compression of the seal in radial direction for substrate support in the radial direction. In certain embodiments, the end cones are configured such that they could slide inside the outer shell while maintaining contact with the inner surface of the shell. The "L" seal material can be chosen such that it has a higher coefficient of thermal expansion than that of the shell material to provide seal contact at relatively higher temperatures. For example, the support seal material can be SS309, SS310, A286, NA6 or a hybrid combination of these materials, or other materials having precipitation or work hardening characteristics. In certain embodiments, the coefficient of thermal expansion of the support seal is higher than that of the shell and inner cone material. For example, the shell and cone material can be SS409 or 18CrCb and the seal material can be SS309. In one embodiment, an inside portion of the support seal is fabricated from SS310 and an outside portion of the support seal is fabricated with A286.

While the best mode for carrying out the invention has been described in detail, those familiar with the art to which this invention relates will recognize various alternative designs and embodiments for practicing the invention as defined by the following claims.

What is claimed is:

1. A support seal for use with a catalytic converter having a housing, which includes an inlet end cone, an outlet end cone, and a shell forming an internal chamber, and catalytic substrate disposed within the internal chamber, the support seal having an "L" shaped cross-section comprising a radial portion and an axial portion, wherein at least one portion includes a collapsible lip collapsing to provide engagement pressure against the catalytic substrate when the at least one portion supports and retains the catalytic substrate within the internal chamber.

2. The support seal of claim 1 wherein the radial portion provides support and retention of the catalytic substrate in a radial direction and the axial portion provides support and retention of the catalytic substrate in an axial direction.

3. The support seal of claim 1 wherein the radial portion provides support and retention of the catalytic substrate primarily in a radial direction and the axial portion provides support and retention of the catalytic substrate primarily in an axial direction.

4. The support seal of claim 1 wherein the radial portion includes a radial engagement surface and the collapsible lip extends outward therefrom, the engagement surface and the collapsible lip engaging a portion of the radial surface of the catalytic substrate.

5. The support seal of claim 1 wherein the axial portion includes an axial engagement surface and the collapsible lip extends outward therefrom, the engagement surface and the collapsible lip engaging a portion of an axial surface of the catalytic substrate.

6. The support seal of claim 5 wherein the width of the axial engagement portion is at least about 0.10 inches.

7. The support seal of claim 1 wherein the support seal exhibits minimal hysterisis after multiple compression and relaxation duty cycles.

8. A catalytic converter assembly, the assembly comprising:

a housing including an inlet end cone, an outlet end cone, and a shell defining an internal chamber, the inlet end cone including an inlet conical section including an inlet conical axis and an inlet annular flange portion substantially axially parallel to the inlet conical axis and the outlet end cone including an outlet conical section including an outlet conical axis and an annular flange portion substantially axially parallel to the outlet conical axis;

a catalytic substrate disposed within the internal chamber; and first and second support seals each having an "L" shaped cross-section comprising a radial portion and an axial portion, a substantial portion of each of the inlet and outlet annular flange portions being disposed within the internal chamber and being substantially radially perpendicular to the shell such that the annular flange portions impart inward engagement pressure towards the center of the housing and against the axial portions of the first and second support seals as each axial portion supports and retains the catalytic substrate within the internal chamber.

9. The catalytic converter assembly of claim 8 wherein the inlet conical section is partially bounded by an inlet annular surface substantially perpendicular to the inlet conical axis, the inlet annular surface and the edge of the shell proximate to the inlet annular surface forming an inlet seam therebetween when the first and second support seals support and retain the catalytic substrate within the internal chamber, and further comprising a welding material disposed within the inlet seam coupling the inlet end cone to the shell.

10. The catalytic converter assembly of claim 9 wherein the outlet conical section is partially bounded by an outlet annular surface substantially perpendicular to the conical axis, the outlet annular surface and the edge of the shell proximate to the outlet annular surface forming an outlet seam therebetween when the first and second support seals support and retain the catalytic substrate within the internal chamber, and the welding material being further disposed within the outlet seam coupling the outlet end cone to the shell.

11. The catalytic converter assembly of claim 10 wherein each annular flange portion has an outer diameter which is equal to the inner diameter of the shell.

12. The catalytic converter assembly of claim 8 wherein each of the inlet and outlet end cones has a large diameter circular end tapering towards a small diameter circular end and each annular flange portion extending radially inward from the large diameter circular end of each end cone, respectively.

13. The catalytic converter assembly of claim 8 wherein the catalytic substrate includes an elongate catalytic brick and one or more rows of plugged cells disposed on each axial side of the elongate catalytic brick.

14. The catalytic converter assembly of claim 8 wherein the first and second support seals are formed of knitted wire mesh.

15. The catalytic converter assembly of claim 8 wherein at least one of the radial portion and the axial portion of at least one of the first and second support seals includes a collapsible lip collapsing to provide engagement pressure against the catalytic substrate when the at least one portion supports and retains the catalytic substrate within the internal chamber.

16. The catalytic converter assembly of claim 15 wherein the axial portion of at least one of the first and second support seals includes an axial engagement surface and the collapsible lip extends outward therefrom, the engagement surface and the collapsible lip engaging a portion of an axial surface of the catalytic substrate.

17. A method of forming a catalytic converter, the method comprising:

disposing a first support seal having an axial portion and a radial portion on the first end of a catalytic substrate;

disposing a second support seal having an axial portion and a radial portion on the second end of the catalytic substrate;

disposing the catalytic substrate and the first and second support seals within a catalytic converter shell having an internal chamber;

aligning an inlet end cone having a conical section including a conical axis and an annular flange portion axially substantially parallel to the conical axis with the second support seal such that a portion of the annular flange portion contacts the second support seal and the housing and a substantial portion of the annular flange portion is disposed within the internal chamber and is substantially radially perpendicular to the housing;

aligning an outlet end cone having a conical section including a conical axis and an annular flange portion substantially axially parallel to the conical axis with the first support seal such that a portion of the annular flange portion contacts the first support seal and the housing and a substantial portion of the annular flange portion is disposed within the internal chamber and is substantially radially perpendicular to the housing; and attaching the inlet end cone and the outlet end cone to the housing such that the annular flange portions impart inward engagement pressure against the axial portions of the first and second support seals as each axial portion supports and retains the catalytic substrate within the internal chamber.

18. The method of claim 17 wherein each aligning step includes applying pressure in the axial direction towards the center of the housing such that each respective support seal is compressed in an axial direction during the attaching step.

19. The method of claim 17 wherein the two aligning steps are carried out simultaneously.

* * * * *